US005570551A

United States Patent [19]

Koc, Sr. et al.

[11] Patent Number: 5,570,551

[45] Date of Patent: Nov. 5, 1996

[54] MODULAR MASONRY KIT

[76] Inventors: Matthew S. Koc, Sr., 70 S. Broadway, Saddlebrook, N.J. 07663; Thomas G. Koc, 53 King Ave., Marlton, N.J. 08053

[21] Appl. No.: 518,809

[22] Filed: Aug. 24, 1995

[51] Int. Cl.[6] ..... E04C 1/00

[52] U.S. Cl. ..... 52/314

[58] Field of Search ..... 52/314, 311.2, 52/612, 566, 567; 446/85

[56] References Cited

U.S. PATENT DOCUMENTS

| | | | |
|---|---|---|---|
| 2,028,997 | 1/1936 | Schmitz | 52/314 X |
| 2,078,329 | 4/1937 | La Spina . | |
| 2,082,457 | 6/1937 | Martinichio | 52/314 X |
| 2,262,199 | 11/1941 | Paulson | 52/314 X |
| 2,336,949 | 12/1943 | Mortimer . | |
| 3,391,507 | 7/1968 | Downing . | |
| 4,275,540 | 6/1981 | Keller . | |
| 4,644,719 | 2/1987 | Salazar . | |
| 4,727,698 | 3/1988 | Altman | 52/314 |
| 4,834,585 | 5/1989 | Hasenwinkle et al. . | |

*Primary Examiner*—Carl D. Friedman
*Assistant Examiner*—Timothy B. Kang
*Attorney, Agent, or Firm*—Terrance L. Siemens

[57] ABSTRACT

A kit of modules simulating brick masonry, for building low walls. In each principal module, individual masonry elements are stacked horizontally, so that each principle module simulates one course of masonry. Three varieties of principal modules are provided, including a base course, an intermediate course, and a top course. The base course has a flat bottom surface, and a simulated horizontal mortar joint extends across the top. The top course has simulated mortar joints inscribed on the top surface, and has a simulated horizontal mortar joint extending across the bottom surface. The intermediate course has no horizontal joint, relying instead on those provided by the top and base course modules. A minor module simulating a mortar joint for the end of a brick is provided so that plural principal modules can abut, thereby extending the length of the wall constructed thereby. A preferred application is to build border walls for shrubs, trees, flower beds, and the like.

8 Claims, 3 Drawing Sheets

MODULAR MASONRY KIT

BACKGROUND OF THE INVENTION

1. Field of the Invention

The present invention relates to a kit comprising complementary modules simulating courses of a brick wall. The four types of elements of the kit include a simulated base course, a simulated center course, a simulated top course, and additional simulated mortar joints. The kit is ideally suited for building low walls.

2. Description of the Prior Art

It is well established that building masonry walls and sections thereof is a tedious task, since a large number of individual bricks or blocks, or their equivalents, must be laid individually. This entails both time and also skill, since a poor impression results from bricks that are not uniformly and evenly aligned throughout all three dimensions. To hasten the process of building such a wall or wall section, the prior art has suggested many designs for prefabricated modules each including many courses of bricks or the like.

U.S. Pat. No. 4,834,585, issued to Earl D. Hasenwinkle et al. on May 30, 1989, most closely illustrates the purpose of the present invention, although departing considerably from the resultant appearance and preferred construction. The low wall shown in this patent is similar in many respects to the low wall which is the subject of the present invention, in that it is employed as a border for shrubbery, trees, flower beds, and the like. However, the appearance resulting from the building module of Hasenwinkle et al. is that of landscape timbers, as contrasted to simulation of bricks in the present invention. The simulation of the present invention has individually articulated individual bricks and associated mortar joints in each module. Also, Hasenwinkle et al. provide vertical holes for accepting fasteners, which holes are absent in the present invention. Instead, the present invention allows for a finished top surface devoid of holes or bores.

Among those masonry modules which intentionally simulate brick masonry, the tendency is to include a significant number of vertically stacked courses in a single module. These are seen in U.S. Pat. Nos. 2,336,949, issued to Norman J. Mortimer on Dec. 14, 1943, 4,275,540, issued to William A. Keller on Jun. 30, 1981, and 4,644,719, issued to Edward J. Salazar on Feb. 24, 1987. While provision of a plurality of stacked vertical courses provides a significant time savings in constructing a tall wall, it contravenes the ability to build a short wall. Even if built to include the three courses provided in the present invention, a unitary three course module has shortcomings. These shortcomings include inability to accommodate corners, inability to form intersections of walls which are perpendicularly oriented to one another, and inability to form even ends of walls.

It is also more difficult to fabricate modules including two or more vertical courses, especially when simulating standard overlapped courses. Therefore, even the relatively uncomplicated two course modules depicted in FIGS. 4 and 5 of Mortimer are not truly suitable for the purposes of the present invention.

U.S. Pat. Nos. 2,078,329, issued to Albert F. La Spina on Apr. 27, 1937, and 3,391,507, issued to Doris D. Downing on Jul. 9, 1968, illustrate blocks of great width, faced with three simulated brick courses. This type of module is unsuitable for the purposes of the present invention because of the considerable weight and depth of the module, and also since the open cores of the blocks are upwardly open. There is no provision for simulation of a corner construction, as detailed above, or of a neat end of a wall.

None of the above inventions and patents, taken either singly or in combination, is seen to describe the instant invention as claimed.

SUMMARY OF THE INVENTION

The present invention is specifically intended for building short walls, preferably simulating three courses in height. The purpose of such a wall is to provide an aesthetic low border for shrubs, trees, flower beds, and the like, which border simulates brick masonry. Such borders frequently form closed figures, wherein there are corners formed at the intersection of two perpendicular walls.

Such walls can extend a considerable length. Therefore, the savings in time achieved by providing modules including a plurality of simulated bricks results from stacking the plurality of simulated bricks horizontally, rather than in the vertical arrangement of the prior art.

This arrangement also expedites fabrication, especially when the module is built from stock lumber. Simulation of recessed mortar joints can be performed by incising a piece of lumber, without concern that a typical vertical joint must be carefully terminated prior to interrupting a brick which is typically staggered in its location above or below the vertical joint.

Lumber is a preferred fabrication material since it is readily available in many lengths, is inexpensive, and is easily worked with ordinary tools and materials. Therefore, little specialized skill is required of a person undertaking to build a finished low wall in modules fabricated from lumber.

Coloring of the bricks can be performed quickly by a roller, without disturbing the recessed mortar joints. The module may be fabricated in a material naturally having a color suitable for the mortar joints. Alternatively, the module may be painted first in a color suitable for mortar joints, then rolled to paint the brick faces.

To these ends, the novel kit includes three principal types of elements. One element is the base course, simulating a course of brick laid directly upon the ground. The second element is the intermediate course, which is laid above the base course. The final simulated brick element is the top course, which caps the assembly. The first and third elements each include a simulated horizontal mortar joint which is recessed with respect to brick faces, and of contrasting color. This horizontal joint is upwardly oriented in the base course, and downwardly oriented in the top course. The intermediate course lacks simulated horizontal mortar joints.

The intermediate course is provided in lengths shorter than those of the base and top course modules by the length of one brick. This arrangement enables staggering or overlapping of overlying and underlying bricks, while accommodating corners formed at the intersections of perpendicularly positioned walls.

Construction of the top and base courses differs in that in the top course, vertical mortar joints are recessed below the level of the visible face of the simulated bricks at the top surface. As employed herein, a vertical mortar joint is that applied to an end face of a simulated brick. By contrast, there are also horizontal mortar joints, which are applied to the underside or top surface of simulated bricks. The step of recessing vertical mortar joints is unnecessary in the base course, since the surface corresponding to the top surface in the top course lies directly on the ground in the base course, and hence is not visible.

An optional fourth type of element is a piece simulating a vertical mortar joint for placement on an end face at one of the other elements. This fourth element, or minor module, is employed when terminating a wall which forms a corner requiring a joint abutting the perpendicular brick.

Accordingly, it is a principal object of the invention to provide simulated masonry modules suitable for building short walls.

It is another object of the invention that each principal module simulate one horizontal course of bricks.

It is a further object of the invention to enable expedient fabrication of the principal modules from stock lumber.

Still another object of the invention is that the modules accommodate corners and intersections in the construction of a multicourse wall.

An additional object of the invention is to provide a kit having simulated base courses, simulated intermediate courses, and simulated top courses of brick masonry.

It is another object of the invention to enable construction of a simulated brick wall or enclosure employing the novel kit to be performed with ordinary tools and materials, and without the use of actual masonry mortar.

Yet another object of the invention is to facilitate staggering of bricks in overlapping pattern in the simulated construction.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
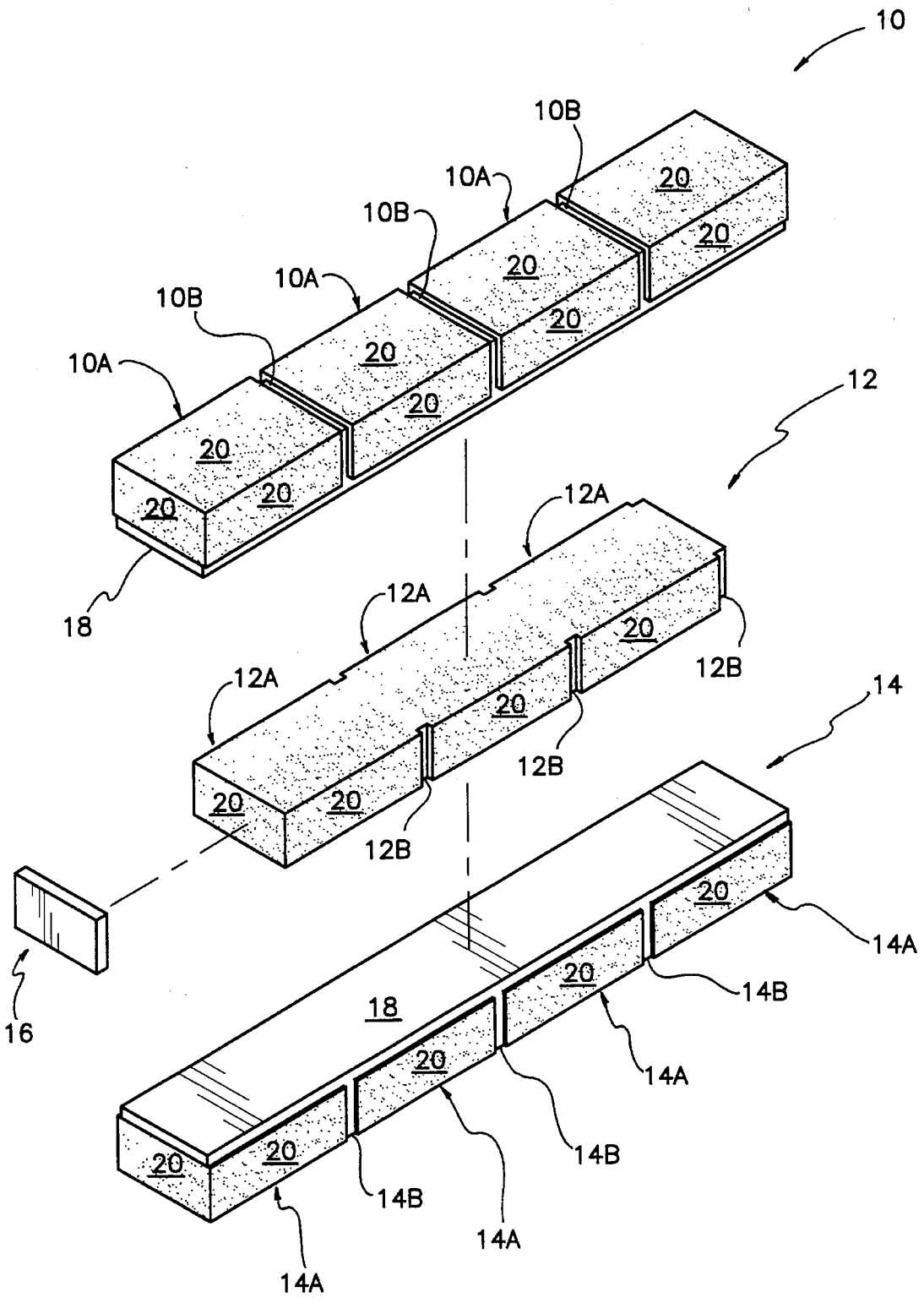
FIG. 1 is an exploded, perspective view of the components of the modular masonry simulating kit.

Turning now to FIG. 1 of the drawings, there is depicted the four components or modules 10, 12, 14, 16 of the novel kit for simulating brick masonry. Components 10, 12, 14 are principal modules, being elongated and simulating a horizontal course of masonry including horizontally abutting bricks with simulated vertical mortar joints disposed between adjacent simulated bricks. Component 16 is a minor module, not required in every application employing the novel kit.

Elongated principal modules 10, 12, 14 share certain characteristics. These modules 10, 12, 14 have first sections 10A, 12A, 14A (respectively) simulating bricks and second sections 10B, 12B, 14A (respectively) simulating vertical mortar joints. Relative to one another, first sections 10A, 12A, 14A are raised, and second sections 10B, 12B, 12C are recessed.

First sections 10A, 12A, 14A alternate with second sections 10B, 12B, 14B in horizontal abutment. In modules 10 and 14, both ends terminate in first sections 10A, 14A (respectively) simulating bricks. By contrast, module 12 has an equal number of first sections 12A, simulating bricks, and second sections 12B, simulating vertical mortar joints.

Modules 10, 14 also each include a simulated horizontal mortar joint 18. Where visible at the lateral surfaces of respective modules 10, 14, joint 18 is recessed. On module 10, joint 18 is located below sections 10A, 10B. On module 14, joint 18 is located above sections 14A, 14B. Joint 18 is thus a horizontal third section of modules 10 and 14.

Figure 2:
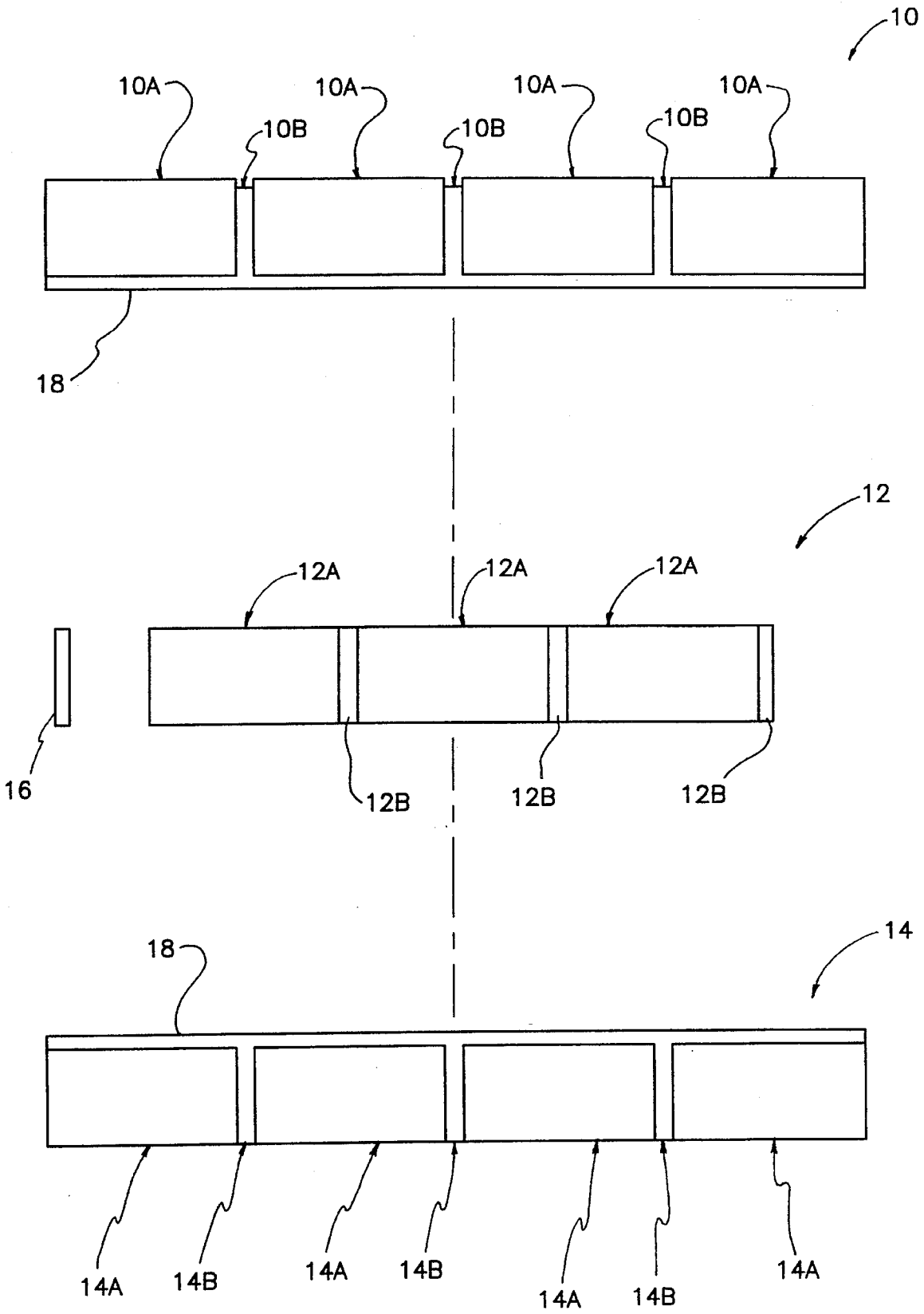
FIG. 2 is an exploded, side elevational view of the components of FIG. 1.

However, modules 10 and 14 are not merely mirror images of one another, as better seen in FIG. 2. On module 14, sections 14B are grooved only at the lateral sides of module 14. On module 10, by contrast, corresponding grooved or recessed sections 10B extend across the top surface of module 10, spanning the lateral sides.

This construction relates to the purpose as follows. Module 14 is a base module having a bottom surface flush across sections 14A, 14B. This is suitable since module 14 rests on the ground when erected, and no visible detail on the bottom is required. Therefore, module 10 simulates a top course of masonry, and module 14 simulates a base course of masonry. Each module 10 or 14 has the necessary cosmetic attributes, and has no wasted structure.

Intermediate module 12 has flat top and bottom surfaces such that mortar joints 12B are flush with upper and lower surfaces of simulated brick sections 12A, and is devoid of a simulated horizontal mortar joint. When modules 10, 12, 14 are assembled, horizontal joints 18 will face one another, thereby surrounding intermediate module 12.

Bricks are naturally of an earth color, ranging from white and buff to yellows, oranges, reds, and even of purplish hue. Mortars are generally white, gray, or buff, and typically contrast with the color of the bricks. To further the simulation of actual masonry, and referring again to FIG. 1, visible faces 20 of brick simulating sections 10A, 12A, 14A are all rendered in a color preferably selected from the range of colors of natural clay bricks. Visible portions for faces of mortar simulating sections 10B, 12B, 14B, and horizontal joints 18 are rendered in a contrasting color. Color rendering may be performed in any suitable way, such as by painting, staining, or coating.

A preferred material for fabricating modules 10, 12, 14, 16 is lumber chemically treated with preservatives. Sections 10B, 12B, 14B and 18 are easily formed by routing a board of lumber to a uniform depth below the outer surface of brick simulating sections 10A, 12A, 14A. Of course, routing will be understood to encompass any abrasive or similar process which removes material from the board of lumber, and may extend to sand and water blasting, burning by flame or laser, and to still other methods.

Although one advantage of lumber is that fabrication is readily performed, similar advantages accrue regarding final assembly. The various modules 10, 12, 14, 16 are easily joined and are cut to desired lengths by conventional methods employing readily available tools and materials.

Modules 10, 12, 14 are readily fastened together by nailing from below, so that the nail heads will not be visible, by employing dowels, and by boring holes in the modules 10, 12, 14, and lowering the modules 10, 12, 14 over rods driven into the ground. Mutual attachment of modules 10 and 12, and of 12 and 14, may be reinforced by application of an adhesive. This process is rendered more effective since the bottom surface of module 10, the top surface of module 14, and both top and bottom surfaces of module 12 are flat.

Should stock modules 10, 12, 14 be too long, they are easily cut by saw. To terminate and complete a wall, for example, a user can cut a half brick section 12A from a spare module 12.

Figure 3:
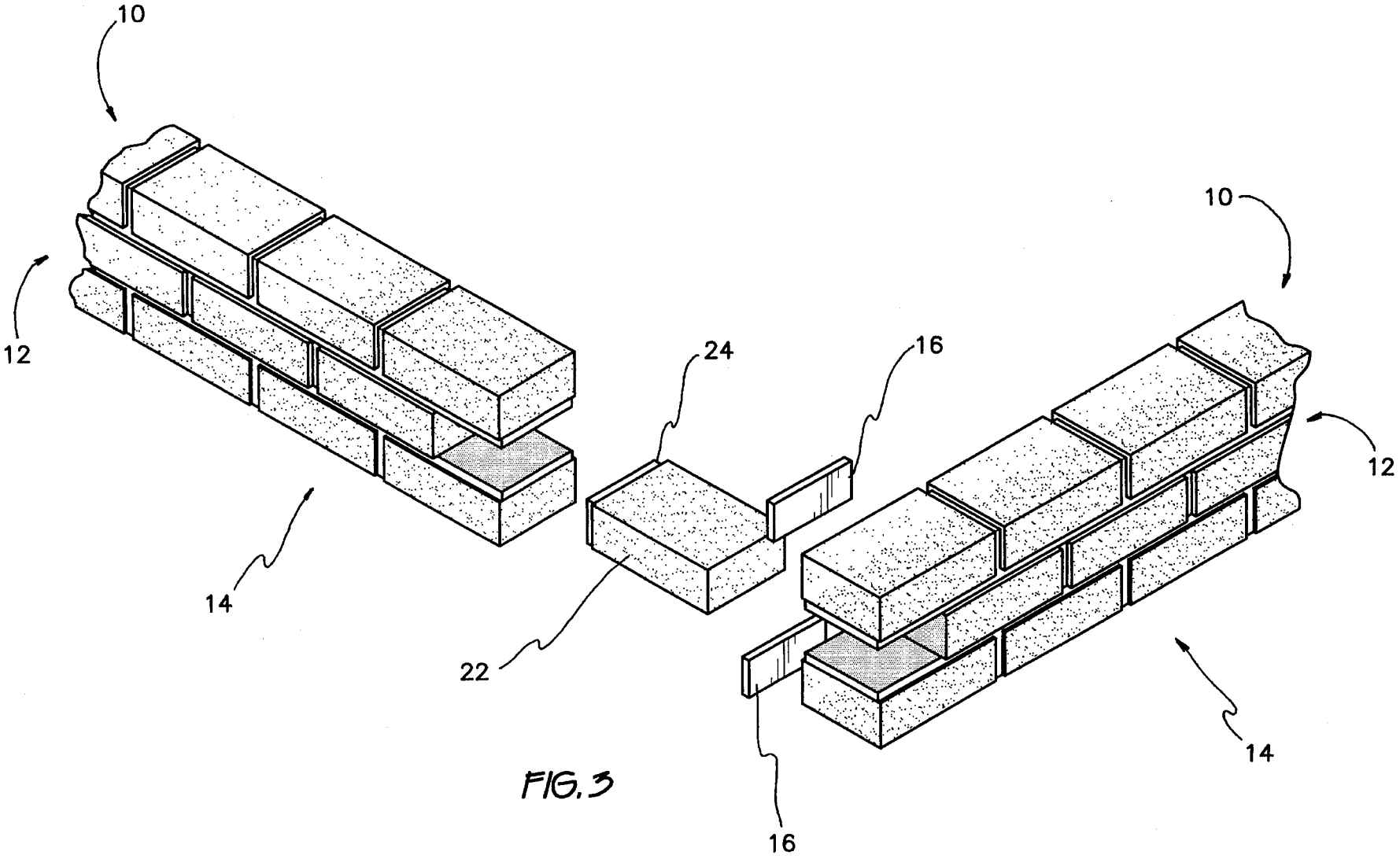
FIG. 3 is a partially exploded, perspective view of a wall construction including a corner, built with components of the modular masonry simulating kit.

Modules 10 and 14 each incorporate one more brick simulating section 10A or 14A than does module 12. Walls having corners or intersections are readily accommodated by this arrangement, as seen in FIG. 3. For each wall, modules 10 and 14 overlie one another, and sandwich module 12.

Module 12 is centered between modules 10, 14, so that a void space equivalent to half the length of a typical brick simulating section 10A, 12A, or 14A is left. A corresponding void is also left in the perpendicular wall which is to be interfit to complete the corner or intersection. A section 12A is cut from a spare module 12, and is placed as shown at 22. Modules 16 are placed as shown. The section 12A cut from the spare module 12 may already include a section 12B simulating a vertical mortar joint, as indicated at 24. If section 12A is not present, a module 16 may be installed thereinstead.

Thus it will be seen that a kit for building long walls is advantageously fabricated from elongated stock material, and simulates brick masonry in a satisfactory manner. The modules of the kit are particularly suitable for constructing square and rectangular border walls around trees, shrubs, flower beds, and the like. The kit is inexpensively fabricated, and is easily worked and assembled.

It is to be understood that the present invention is not limited to the embodiments described above, but encompasses any and all embodiments within the scope of the following claims.

We claim:

1. A kit of elongated modules for simulating brick masonry, comprising at least one base module, at least one intermediate module, and at least one top module having lateral sides, each one of said at least one base module, each one of said at least one intermediate module, and each one of said at least one top module having raised first sections simulating bricks and recessed second sections simulating mortar joints, said first sections alternating with said second sections, said second sections being vertical, and said first sections and said second sections disposed in horizontal abutment, whereby each one of said at least one base module, said at least one intermediate module, and said at least one top module simulates a horizontal course of bricks, said base module having a flat unbroken bottom surface flush across said first sections and said second sections and a horizontal third section disposed atop said first sections and said second sections, said third section being recessed and spanning all said first sections and all said second sections of said base module, whereby said base module includes a simulated horizontal mortar joint;

said intermediate module having flat unbroken top and bottom surfaces; and said second sections of said top modules being recessed across the top of said top module and also being recessed on said lateral sides of said top module, thereby simulating a top course of brick masonry, said top module having a horizontal third section disposed below said first sections and said second sections of said top module, said third section being recessed at said lateral sides of said top module and flat at the bottom side of said top module, and spanning all said first sections and all said second sections of said top module, whereby said top module includes a simulated horizontal mortar joint;

said base module including a predetermined number of said first sections simulating bricks, said top module including an equal number of said first sections simulated bricks, and said intermediate module including a number of said first sections simulating bricks being one fewer than said predetermined number of said first sections simulating bricks of said base module and said top module.

2. The kit according to claim 1, said first sections having visible faces rendered in a first color, and said second sections having visible faces rendered in a contrasting color.

3. The kit according to claim 1, each one of said at least one base module, each one of said at least one intermediate module, and each one of said at least one top module being fabricated from a board of lumber, said second sections formed by routing the outer surface of said board of lumber.

4. The kit according to claim 1, further comprising an end module simulating a mortar joint for placement on an end of a said elongated module of said kit, said end module comprising a rectangular section of material identical to that forming said second sections of said elongated modules of said kit, said end module having a height dimension, a width dimension, and a thickness dimension equal to those of said second sections of said elongated modules.

5. The kit according to claim 1, each said base module and each said top module having at least three said raised first sections, and said intermediate module having at least two said first sections.

6. A kit of elongated modules for simulating brick masonry, comprising at least one base module, at least one intermediate module, and at least one top module having lateral sides, each one of said at least one base module, each one of said at least one intermediate module, and each one of said at least one top module having raised first sections simulating bricks and recessed second sections simulating mortar joints, said first sections alternating with said second sections, said second sections being vertical, and said first sections and said second sections disposed in horizontal abutment, whereby each one elongated module simulates a horizontal course of bricks;

each one of said at least one base module having a flat unbroken bottom surface flush across said first sections and said second sections, and a horizontal third section disposed atop said first sections and said second sections, said third section being recessed and spanning all said first sections and all said second sections of said base module, whereby said base module includes a simulated horizontal mortar joint;

each one of said at least one intermediate module having flat unbroken top and bottom surfaces; and each one of said at least one top module having second sections which are recessed across the top of said top module and which are also incluse on said lateral sides of said top module, thereby simulating a top course of brick masonry, said top module also having a horizontal third section disposed below said first sections and said second sections of said top module, said third section being recessed at said lateral sides of said top module and flat at the bottom side of said top module, and spanning all said first sections and all said second sections of said top module, whereby said top module includes a simulated horizontal mortar joint, said top module and said base module each having ends terminating in said first sections simulating bricks, and said intermediate module having one end terminating in a said first section simulating a brick and another end terminating in a said second section simulating a mortar joint.

7. The kit according to claim 6, said at least one base module, said at least one intermediate module, and said at least one top module being fabricated from a board of lumber, said second sections of said at least one base module, said at least one intermediate module, and said at least one top module formed by routing the outer surface of said board of lumber.

8. The kit according to claim 6, each said base module and each said top module having at least three said raised first sections, and said intermediate module having at least two said first sections.

* * * * *